US010169977B2

(12) United States Patent
Steinbok

(10) Patent No.: US 10,169,977 B2
(45) Date of Patent: Jan. 1, 2019

(54) SERVING UTENSIL PLACEMENT MONITORING SYSTEM

(71) Applicant: Harry Steinbok, Boca Raton, FL (US)

(72) Inventor: Harry Steinbok, Boca Raton, FL (US)

( * ) Notice: Subject to any disclaimer, the term of this patent is extended or adjusted under 35 U.S.C. 154(b) by 0 days.

(21) Appl. No.: 14/990,748

(22) Filed: Jan. 7, 2016

(65) Prior Publication Data

US 2016/0203698 A1 Jul. 14, 2016

Related U.S. Application Data

(60) Provisional application No. 62/101,365, filed on Jan. 8, 2015, provisional application No. 62/206,180, filed on Aug. 17, 2015.

(51) Int. Cl.

| | |
|---|---|
| ***G08B 21/18*** | (2006.01) |
| ***A47G 29/00*** | (2006.01) |
| ***G08B 13/24*** | (2006.01) |
| ***G08B 21/24*** | (2006.01) |
| *A47F 10/06* | (2006.01) |

(52) U.S. Cl.

CPC ..... *G08B 21/18* (2013.01); *A47G 29/00* (2013.01); *G08B 13/2402* (2013.01); *G08B 21/24* (2013.01); *A47F 10/06* (2013.01); *A47G 2400/02* (2013.01)

(58) Field of Classification Search

CPC .... G08B 21/18; G08B 13/2402; G08B 21/24; A47G 29/00; A47G 2400/02

See application file for complete search history.

(56) References Cited

U.S. PATENT DOCUMENTS

| | | | |
|---|---|---|---|
| 3,217,509 | A | 11/1965 | Weil et al. |
| 3,840,261 | A | 10/1974 | Fulkerson |
| 4,012,732 | A | 3/1977 | Herrick |
| 4,334,145 | A | 6/1982 | Norris, Sr. |
| 4,458,960 | A | 7/1984 | Dunst |

(Continued)

FOREIGN PATENT DOCUMENTS

| | | |
|---|---|---|
| CN | 202426382 | 9/2012 |
| CN | 202714716 U | 6/2013 |

(Continued)

*Primary Examiner* — Patrick Edouard
*Assistant Examiner* — Eboni Hughes
(74) *Attorney, Agent, or Firm* — Allen D. Hertz, P.A.; Allen D. Hertz

(57) ABSTRACT

A utensil storage monitoring system comprising a microprocessor, a serving utensil sensor in signal communication with the microprocessor, a clocking circuit and at least one alerting component. The system identifies when a serving utensil is removed from a serving utensil holster or a serving utensil rest and initiates the clocking circuit. The system monitors the status of the serving utensil and the passing time. When the passing time exceeds a predetermined allowable "in-use" time period, the system initiates an alert. The alert can be a visual alert, an audible alert, or any other alert. The alert can escalate if the serving utensil is not returned to the holster/rest in a timely manner. The system can associate a specific serving utensil with the respective monitoring system to avoid cross contamination. The system can additionally include a sterilization component. The system can be integrated into a utensil status and data acquisition system.

19 Claims, 9 Drawing Sheets

(56) References Cited

U.S. PATENT DOCUMENTS

| | | | | |
|---|---|---|---|---|
| 4,499,368 | A | 2/1985 | Payne | |
| 4,577,181 | A | 3/1986 | Lipscher et al. | |
| 4,975,682 | A | 12/1990 | Kerr et al. | |
| 5,227,765 | A | 7/1993 | Ishizuka | |
| 5,241,297 | A | 8/1993 | Goodman | |
| 5,543,784 | A | 8/1996 | Mendenhall | |
| 5,613,660 | A | 3/1997 | Wyatt | |
| 5,614,886 | A | 3/1997 | Snell et al. | |
| 5,939,974 | A | 8/1999 | Heagle | |
| 6,411,215 | B1 | 6/2002 | Shnier | |
| 6,412,398 | B1 | 7/2002 | Norcross et al. | |
| 6,558,165 | B1 | 5/2003 | Curry et al. | |
| 6,591,739 | B2 | 7/2003 | Norcross | |
| 7,205,894 | B1 | 4/2007 | Savage | |
| 7,673,769 | B2 | 3/2010 | McRorie, III | |
| 7,808,388 | B2 * | 10/2010 | Kangas | G06Q 10/087 340/10.1 |
| 8,297,473 | B2 | 10/2012 | Smith | |
| 8,310,368 | B2 | 11/2012 | Hoover et al. | |
| 8,429,827 | B1 | 4/2013 | Wetzel | |
| 9,477,962 | B2 * | 10/2016 | Worrall | G06Q 30/018 |
| 9,761,100 | B2 * | 9/2017 | Anson | G08B 21/24 |
| 2004/0112078 | A1 | 6/2004 | Kateman et al. | |
| 2004/0250554 | A1 | 12/2004 | Kateman et al. | |
| 2005/0098170 | A1 | 5/2005 | Raynor | |
| 2005/0198990 | A1 | 9/2005 | Kateman et al. | |
| 2006/0162348 | A1 | 7/2006 | Kateman et al. | |
| 2007/0273513 | A1 * | 11/2007 | White | G07F 9/026 340/568.8 |
| 2010/0242497 | A1 | 9/2010 | Bertone | |
| 2010/0252626 | A1 * | 10/2010 | Elizondo | G06Q 10/087 235/385 |
| 2013/0081249 | A1 | 4/2013 | McLean | |
| 2013/0203024 | A1 | 8/2013 | Dekar | |
| 2013/0273508 | A1 | 10/2013 | Hyde et al. | |
| 2015/0359387 | A1 * | 12/2015 | Ramirez | A47J 43/287 374/141 |

FOREIGN PATENT DOCUMENTS

| | | | |
|---|---|---|---|
| CN | 103687517 | A | 3/2014 |
| JP | H05266358 | A | 10/1993 |
| JP | 2006/078056 | | 3/2006 |
| TN | 200807337 | A | 1/2008 |

* cited by examiner

SERVING UTENSIL PLACEMENT MONITORING SYSTEM

CROSS-REFERENCE TO RELATED APPLICATIONS

This Non-Provisional patent application claims the benefit of U.S. Provisional Patent Application Ser. No. 62/101,365, filed on Jan. 8, 2015, and U.S. Provisional Patent Application Ser. No. 62/206,180, filed on Aug. 17, 2015, both of which are incorporated herein in their entireties.

FIELD OF THE INVENTION

The present disclosure generally relates to an apparatus and method for monitoring a presence and time of absence of a utensil. More specifically, the apparatus comprises a monitoring system for alerting a service person when a utensil is removed from a utensil storage location for greater than a predetermined period of time.

BACKGROUND OF THE INVENTION

Food service establishments, such as restaurants, kitchens, or any other commercial establishment where food is served, employ serving utensils for serving food, ice, salads, bread, condiments, garnishes, and the like. The use of the serving utensils introduces a potential health hazard for the food service facility's patrons. For example, leaving the serving utensil exposed for an extended period of time introduces a potential for contamination from extended exposure to airborne contaminants, bacteria and viruses carried by patrons, etc. In another example, a lack of control of the serving utensils can introduce a potential of cross contamination from different foods. More specifically, a person may inadvertently use a serving utensil designated to serve lettuce for distribution of peanuts. The contact with the peanuts may transfer oils or other residue onto the serving utensil. The serving utensil would be returned for continued use for serving lettuce. The residue may inadvertently be transferred to the lettuce and consumed by a person having allergies to peanuts, exposing the person to a potential allergic health risk.

Health departments mandate that food and serving utensils be protected from unnecessary handling, coughs and sneezes, dust, flies, rodents or other vermin, and other potential sources of contamination. To protect the general public from food related illnesses, many health departments mandate that food preparation and dispensing utensils shall be stored during pauses in food preparation or dispensing. This is complicated when the food serving establishment offers buffets, salad bars, and the like, where the patrons server themselves. The patrons are not aware or educated regarding health department practices; more specifically, the return of serving utensils to dedicated storage locations or serving utensil rests.

Regarding one specific application, ice-dispensing utensils shall be stored on a clean surface or in the ice with the dispensing utensil's handle extended out of the ice. Between uses, ice transfer utensils shall be stored in a way that protects the utensils from contamination. Again, this expectation is generally faltered when the process relies upon the patrons to return the serving utensils to their proper storage location or rest.

Similar can be applied to serving spoons, forks, tongs, and the like.

Therefore, an apparatus and associated process for identifying when a serving utensil is separated from the associated serving utensil rest over a predetermined time is desirable. It would be beneficial if the solution were adaptable to existing installations. Additional advantages are noted when the apparatus identifies and associates a specific serving utensil with a specific serving utensil rest or holster.

SUMMARY OF THE INVENTION

The present disclosure is generally directed towards an apparatus and respective method of use for identifying when a serving utensil is removed from a utensil rest or holster and how long the serving utensil is removed therefrom. The utensil storage monitoring system activates an alert when the serving utensil has been removed from the utensil rest or holster for a period of time equal to or greater than a predetermined allowable time period.

One embodiment of the present invention is a utensil storage monitoring system comprising:

a microprocessor;

a serving utensil sensor in signal communication with the microprocessor; and at least one alerting component, wherein, the microprocessor operates in accordance with a set of utensil monitoring instructions, the set of utensil monitoring instructions including:

sensing when a serving utensil is removed from a serving utensil storage station, clocking time following the removal of the serving utensil from the serving utensil storage station, determining if the clocked time is equal to or greater than a predetermined allowable in-use time period, activating the at least one alerting component when the clocked time is equal to or greater than a predetermined allowable in-use time period.

In a second aspect, the set of utensil monitoring instructions further comprises a step of:

sensing when the serving utensil is returned to the one of the serving utensil rest or the serving utensil holster.

In another aspect, the set of utensil monitoring instructions further comprises a step of:

resetting the clocked time upon determination that the serving utensil is returned to the one of the serving utensil rest or the serving utensil holster.

In yet another aspect, the alerting process is escalated if the serving utensil is not returned to the serving utensil storage station.

In yet another aspect, serving utensil storage station is one of a serving utensil rest or a serving utensil holster.

In yet another aspect, the at least one alerting component includes an audible alert.

In yet another aspect, the at least one alerting component includes a visual alert. The visual alert can be any light emitting element, including an incandescent bulb, a light emitting diode (LED), a florescent bulb, and the like. The light emitting element can emit a solid light, a flashing light, a colored light, a red colored light, and the like, or any combination thereof.

In yet another aspect, the utensil storage monitoring system further comprises a stored serving utensil indicator.

In yet another aspect, the stored serving utensil indicator can be a visual indicator. The visual indicator can be any light emitting element, including an incandescent bulb, a light emitting diode (LED), a florescent bulb, and the like.

The light emitting element can emit a solid light, a flashing light, a colored light, a green colored light, and the like, or any combination thereof.

In yet another aspect, the serving utensil sensor can be at least one of a proximity sensor, a magnetic read switch, an ultrasonic proximity sensor, an ultraviolet (UV) proximity sensor, an acoustic proximity sensor, and the like.

In yet another aspect, the serving utensil is uniquely identified by the serving utensil sensor.

In yet another aspect, the serving utensil is uniquely identified by the serving utensil sensor by employing a coded radio frequency (RF) communication interface and associated hardware and instruction sets.

In yet another aspect, the serving utensil sensor can utilize a radio frequency (RF) communication provided between a radio frequency (RF) transceiver and a radio frequency (RF) tag, wherein the radio frequency (RF) transceiver is integrated into the utensil storage monitoring system and the radio frequency (RF) tag is attached to the serving utensil.

In yet another aspect, the serving utensil is uniquely identified by the serving utensil sensor by employing a machine readable scanner and associated hardware and instruction set in conjunction with a machine readable label. The machine readable label can be a barcode, a Quick Read (QR) code, or any other suitable machine readable format.

In yet another aspect, the system can include a sterilization component. Each sterilization component would be in operational communication with the microprocessor. One exemplary sterilization component is an ultraviolet light (UV) emitter. A second exemplary sterilization component is heat emitter, such as a steam generator. A third exemplary sterilization component is an ozone emitter.

In yet another aspect, the utensil storage monitoring system further comprises a power supply. The power supply can be provided by a wall outlet, a portable power source, an integrated power generator (such as a solar power converter, a wind driven turbine, a thermo-differential power generator, and the like), or any other power source.

In yet another aspect, the utensil storage monitoring system further comprises a portable power supply. The portable power supply can be batteries, a capacitor, a super-capacitor, a portable power generator (such as a solar power converter, a wind driven turbine, a thermo-differential power generator, and the like), or any other suitable portable power generator.

In yet another aspect, the utensil storage monitoring system further comprises a voltage regulating circuit.

In yet another aspect, the utensil storage monitoring system further comprises each of an external power input and a portable power supply, wherein the system can be power by either power source. The external power input can provide a recharging source to the portable power supply.

In yet another aspect, the utensil storage monitoring system can be integrated into a serving utensil holster.

In yet another aspect, the utensil storage monitoring system can be integrated into a serving utensil rest.

In yet another aspect, the utensil storage monitoring system can be integrated into a utensil storage monitoring system housing, wherein the housing can be inserted into or assembled into any of the serving utensil holster, the serving utensil rest, or any other suitable serving utensil storage station.

In yet another aspect, the utensil storage monitoring system can be used in conjunction with an ice scoop, a serving fork, a serving spoon, a serving knife, a serving tongs, or any other serving utensil.

In yet another aspect, the utensil storage monitoring system can be carried by the utensil.

In yet another aspect, the utensil storage monitoring system can be encased in a water resistant or waterproof case.

In yet another aspect, the utensil storage monitoring system can be carried by a food serving container, such as an ice storage and distribution container. The utensil storage monitoring system would be mounted to the food serving container and adapted to identify when the utensil is inserted into the food serving container and monitor a length of time since the utensil is inserted into the food serving container. The utensil identification system can employ any device suitable for identifying the presence of the utensil within the food serving container.

In yet another aspect, the utensil storage monitoring system can include a communication circuit for communicating with a remotely located apparatus.

In yet another aspect, the utensil storage monitoring system can include a wireless communication circuit for wirelessly communicating with a remotely located apparatus.

In yet another aspect, the utensil storage monitoring system can be adapted to forward an alert to a wireless notification device. The wireless notification device can be a cellular telephone, a Smartphone, a remote server, an email system, a pager, a portable data assistant (PDA), a computing tablet, a point of sale (POS) system), a table seat planning system, and the like.

In yet another aspect, the utensil storage monitoring system can include a utensil status and data acquisition system. The utensil storage monitoring system can be in wired and/or wireless communication with the utensil status and data acquisition system.

In yet another aspect, the utensil status and data acquisition system includes an electronic server in signal communication with a digital storage medium.

In yet another aspect, the utensil status and data acquisition system can includes a utensil status monitor, wherein the utensil status monitor would be adapted to display data associated with the status of at least one monitored utensil. The data can include a utensil identifier, a time when the utensil was removed from the holster, a time when the utensil was returned to the holster, an alarm activation indicator, a current time, and the like.

In yet another aspect, the present invention discloses a method of using the utensil status monitoring system, the method comprising the steps:

- employing a utensil storage monitoring system within one of a serving utensil holster or a serving utensil rest;
- activating the utensil storage monitoring system;
- placing a serving utensil in or one the one of the serving utensil holster or the serving utensil rest respectively;
- removing the serving utensil from the one of the serving utensil holster or the serving utensil rest;
- indentifying the removal of the serving utensil from the one of the serving utensil holster or the serving utensil rest;
- initiating a time monitoring process by starting a timing clock;
- determining if the serving utensil is returned to the one of the serving utensil holster or the serving utensil rest within a predetermined allocated serving utensil usage time; and
- activating at least one alerting component when the clocked time is equal to or greater than a predetermined allowable in-use time period.

In yet another aspect, the method further comprising steps of:

indentifying when the serving utensil is returned to the one of the serving utensil holster or the serving utensil rest respectively; and terminating operation of the alert when the serving utensil is returned to the one of the serving utensil holster or the serving utensil rest.

In yet another aspect, the method further comprising steps of:

indentifying if the serving utensil is returned to the one of the serving utensil holster or the serving utensil rest respectively; and escalating operation of the alert when the serving utensil is not returned to the one of the serving utensil holster or the serving utensil rest over an extended period of time.

In yet another aspect, wherein the step of escalating the alert comprises a step of increasing a volume of the audible alert.

In yet another aspect, wherein the step of escalating the alert comprises a step of increasing a frequency of the audible alert tones.

In yet another aspect, wherein the step of escalating the alert comprises a step of modifying a visual alerting method. The visual alerting method can be a strobing light, a solid light, a color changing light, and the like, or any combination thereof.

These and other aspects, features, and advantages of the present invention will become more readily apparent from the attached drawings and the detailed description of the preferred embodiments, which follow.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
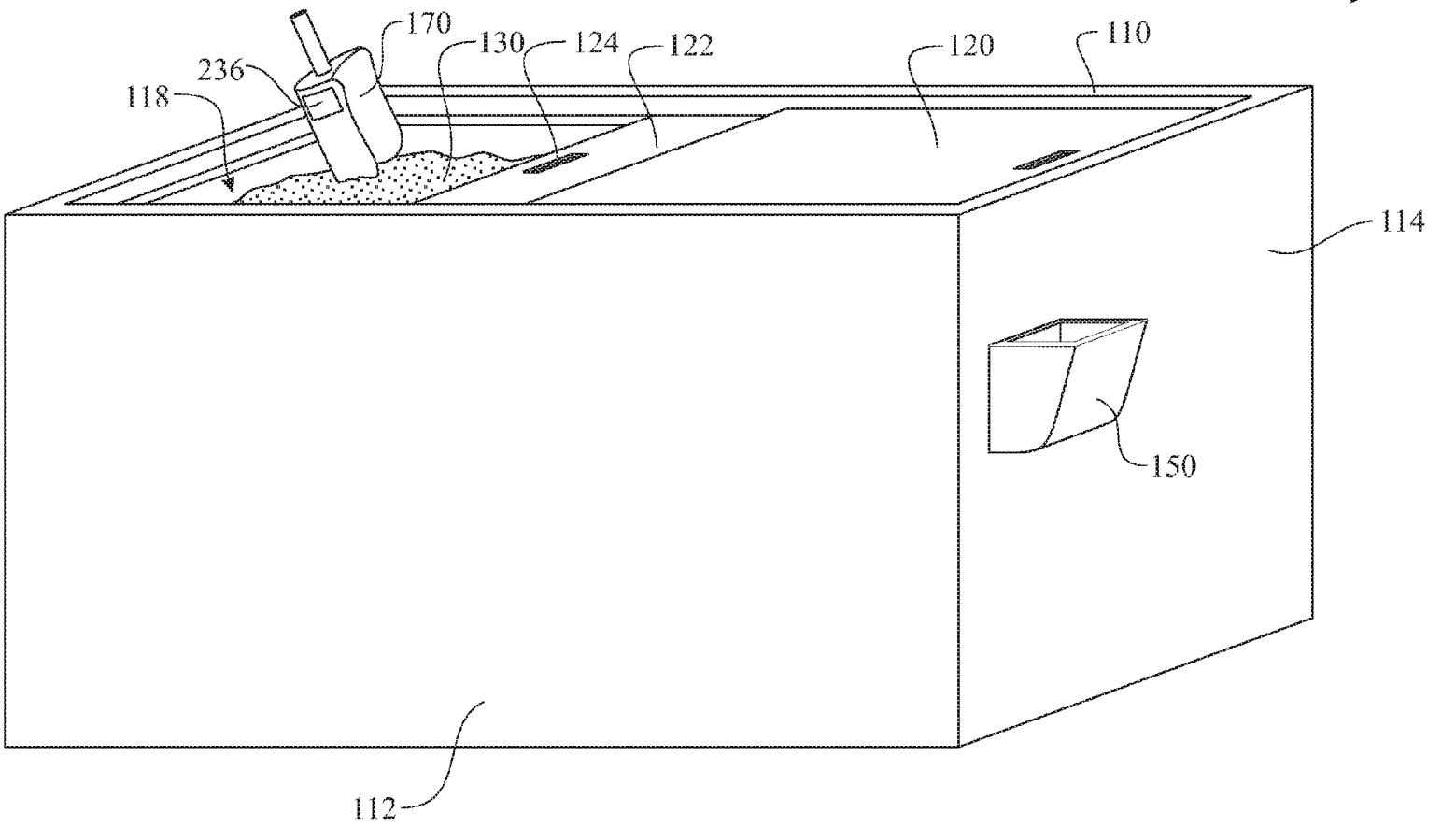
FIG. 1 presents an isometric front-side view of an exemplary ice storage and distribution container having an ice scoop holster for receiving and storing an ice scoop for distribution of ice from the ice storage and distribution container, wherein the ice scoop is shown removed from the ice scoop holster.
Figure 2:
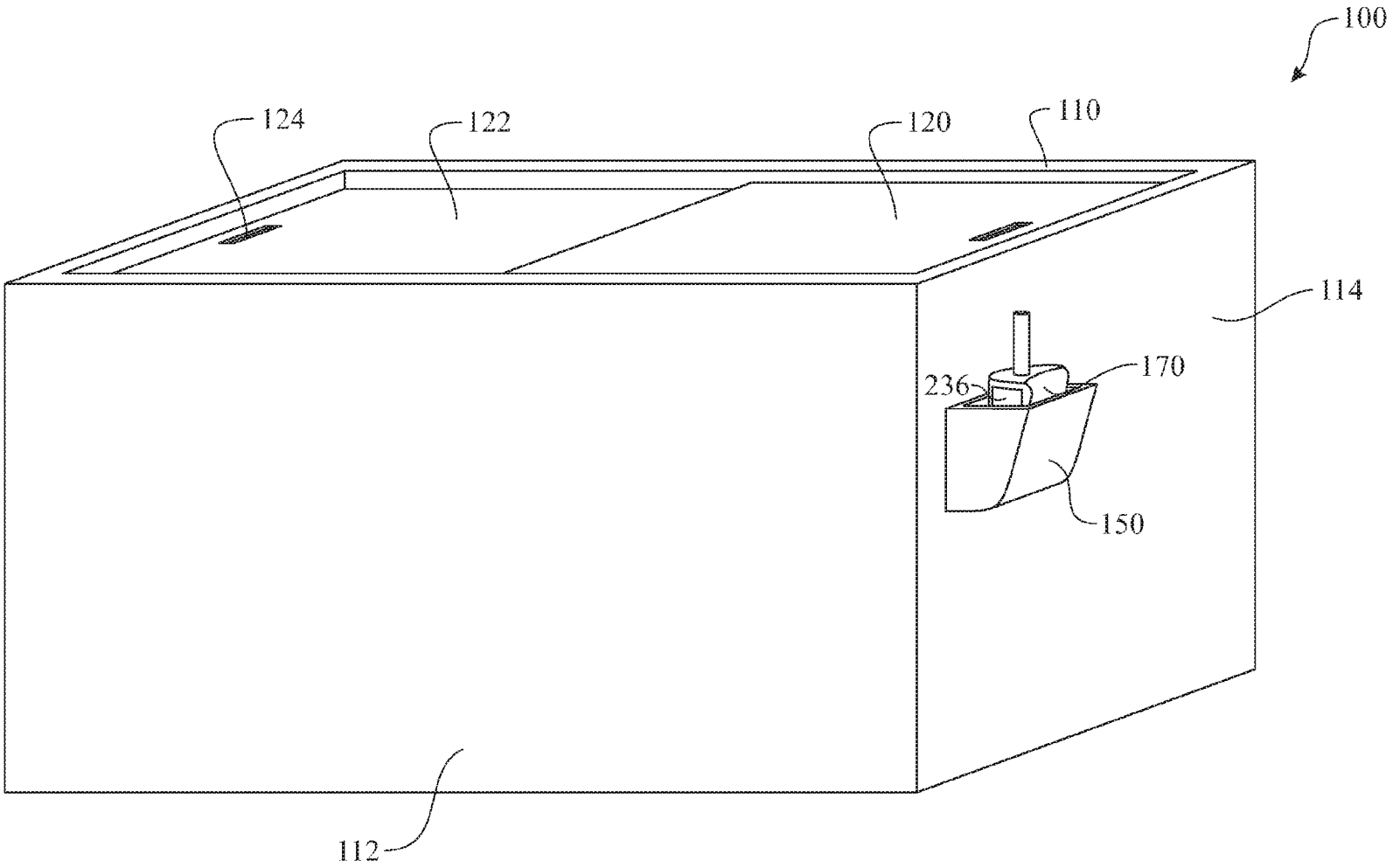
FIG. 2 presents an isometric front-side view of the ice storage and distribution container introduced in FIG. 1, wherein the ice scoop is shown stored within the ice scoop holster.

Food serving establishments commonly serve refreshments with ice. The ice 130 is stored within an ice distribution container 100 as illustrated in FIGS. 1 and 2. The ice distribution container 100 can be any suitable ice container, including a top access ice container, a front access ice container, an ice making machine having an ice storage area, and the like. The common denominator for all of the variants of the ice distribution container 100 is the use of an ice scoop 170 for obtaining and serving the ice from the ice distribution container 100, as shown in FIG. 1. The exemplary ice distribution container 100 is a top accessing ice container having a body comprising an ice container upper surface 110, an ice container front panel 112, a pair of ice container side panels 114, a rear panel (opposite the ice container side panel 114), and a bottom panel (not shown but understood by description). The various panels are joined together defining an ice storage volume 118. The ice distribution container 100 can include an inner layer, an outer layer, and insulation provided therebetween. The stored ice 130 can be provided in bulk from an external source and transferred into the ice storage volume 118 or formed using an ice maker integrated with the ice distribution container 100 and dispensed into the ice storage volume 118.

In the exemplary illustration, an ice container lower sliding panel 122 is slid under an ice container upper sliding panel 120, providing access to the stored ice 130 stored within the ice storage volume 118 of the ice distribution container 100. An ice container sliding panel hand grip 124 can be integrated into the ice container lower sliding panel 122, aiding the user during the process of sliding the ice container lower sliding panel 122 into an open position. The ice container sliding panel hand grip 124 would be designed to ensure against any interference with the ice container upper sliding panel 120 during the opening and closing sliding processes. It is understood that the ice container upper sliding panel 120 and ice container lower sliding panel 122 can alternatively be pivotally assembled to the ice container upper surface 110.

Figure 3:
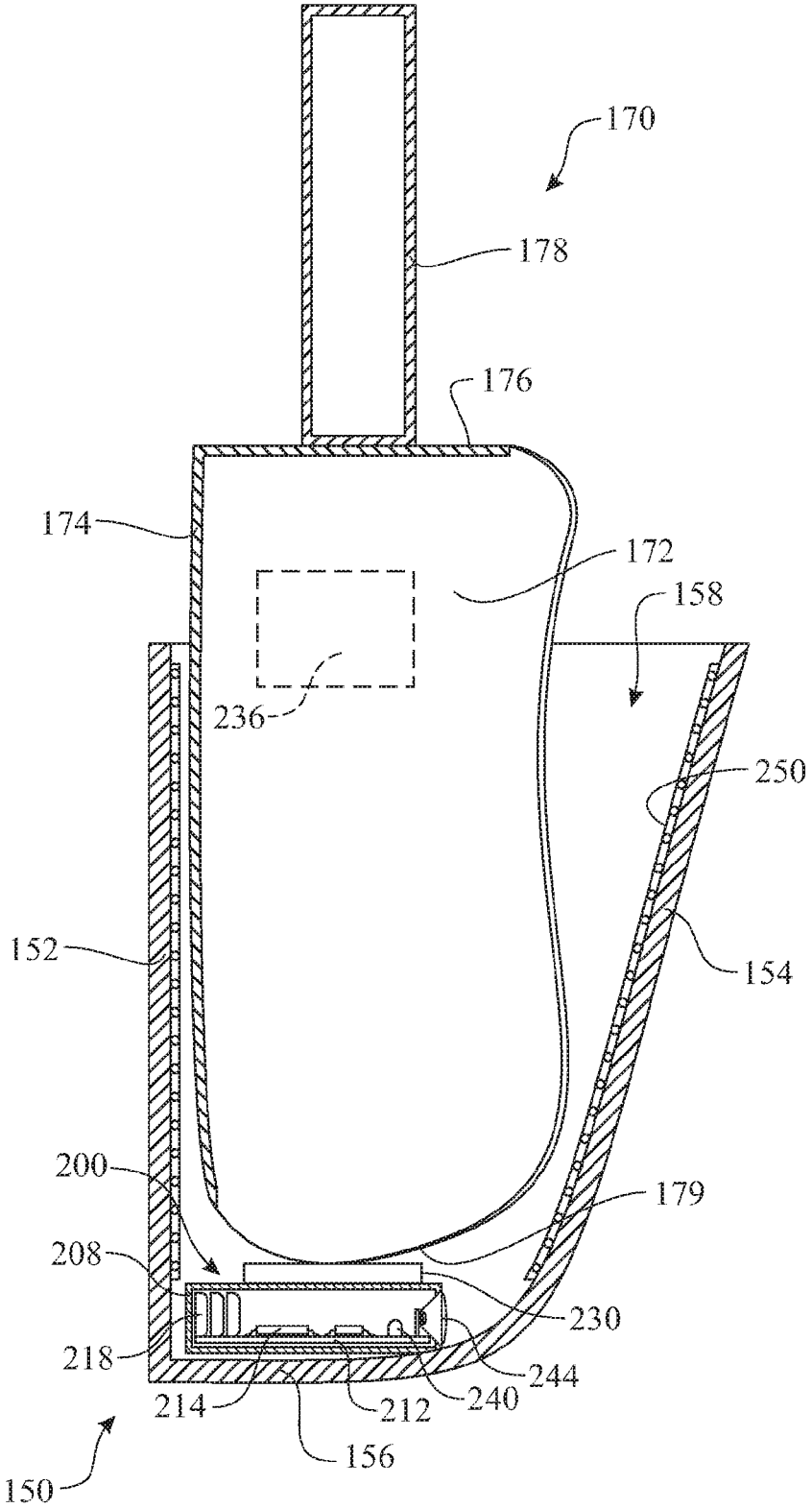
FIG. 3 presents a sectioned side view of the ice scoop stored within the ice scoop holster, the illustration introducing an exemplary utensil storage monitoring system.

It is understood that the stored ice 130 can be served by a food serving establishment employee, a food serving establishment patron, or any other individual. The stored ice 130 is collected from and served using an ice scoop 170. To minimize contamination, the ice scoop 170 should be stored in an ice scoop holster 150 at all times other then when used for serving the stored ice 130, as illustrated in FIGS. 2 and 3. Contamination of the ice scoop 170 can transfer into food and/or beverages being served for consumption. In a worst case scenario, the contamination can be transferred to the stored ice 130 stored within the ice storage volume 118, wherein the contamination would then be disbursed throughout the stored ice 130 and ultimately be distributed to a large number of patrons through dispensing of the contaminated stored ice 130.

Features of the ice scoop holster 150 and the ice scoop 170 are best identified in the illustration presented in FIG. 3. The ice scoop 170 includes an ice collecting scoop 172 formed to collect and dispense stored ice 130 from the ice storage volume 118 of the ice distribution container 100. A portion of the ice collecting scoop 172 is referred to as an ice scoop bottom surface 174. A distal portion of the ice collecting scoop 172 is referred to as an ice scoop distal edge 179. An ice scoop rear surface 176 extends across an upper region of the ice collecting scoop 172. The ice scoop rear surface 176 is provided to support an ice scoop handle 178. The ice scoop handle 178 is shaped to be gripped by a user. The ice scoop 170 would be fabricated of any suitable material, including a metal (stainless steel, aluminum, etc.), a rigid plastic, or any other suitable material.

The exemplary ice scoop holster 150 includes an ice scoop holster attachment panel 152 having a planar surface for attachment to the ice distribution container 100, an ice scoop holster retention panel 154 providing, in combination with the ice scoop holster attachment panel 152, a holster ice scoop receptacle 158 for receiving and storing the ice scoop 170. An ice scoop holster base panel 156 can be integrated defining a lower or base surface of the ice scoop holster 150. It is understood that one or more drain orifices can be integrated into the ice scoop holster base panel 156. The exemplary ice scoop holster 150 is designed to receive and retain the ice scoop 170. The exemplary ice scoop holster 150 is representative of any serving utensil holster or serving utensil rest, wherein the serving utensil holster or serving utensil rest would be shaped to receive and store the associated serving utensil.

A utensil storage monitoring system 200 can be employed to determine when the ice scoop 170 is removed from the ice scoop holster 150 and monitor a time period between when the ice scoop 170 is removed from the ice scoop holster 150 and the ice scoop 170 is returned to the ice scoop holster 150. The utensil storage monitoring system 200 can be designed to be retrofitted into an existing ice scoop holster 150 or integrated into a custom ice scoop holster 150.

Figure 4:
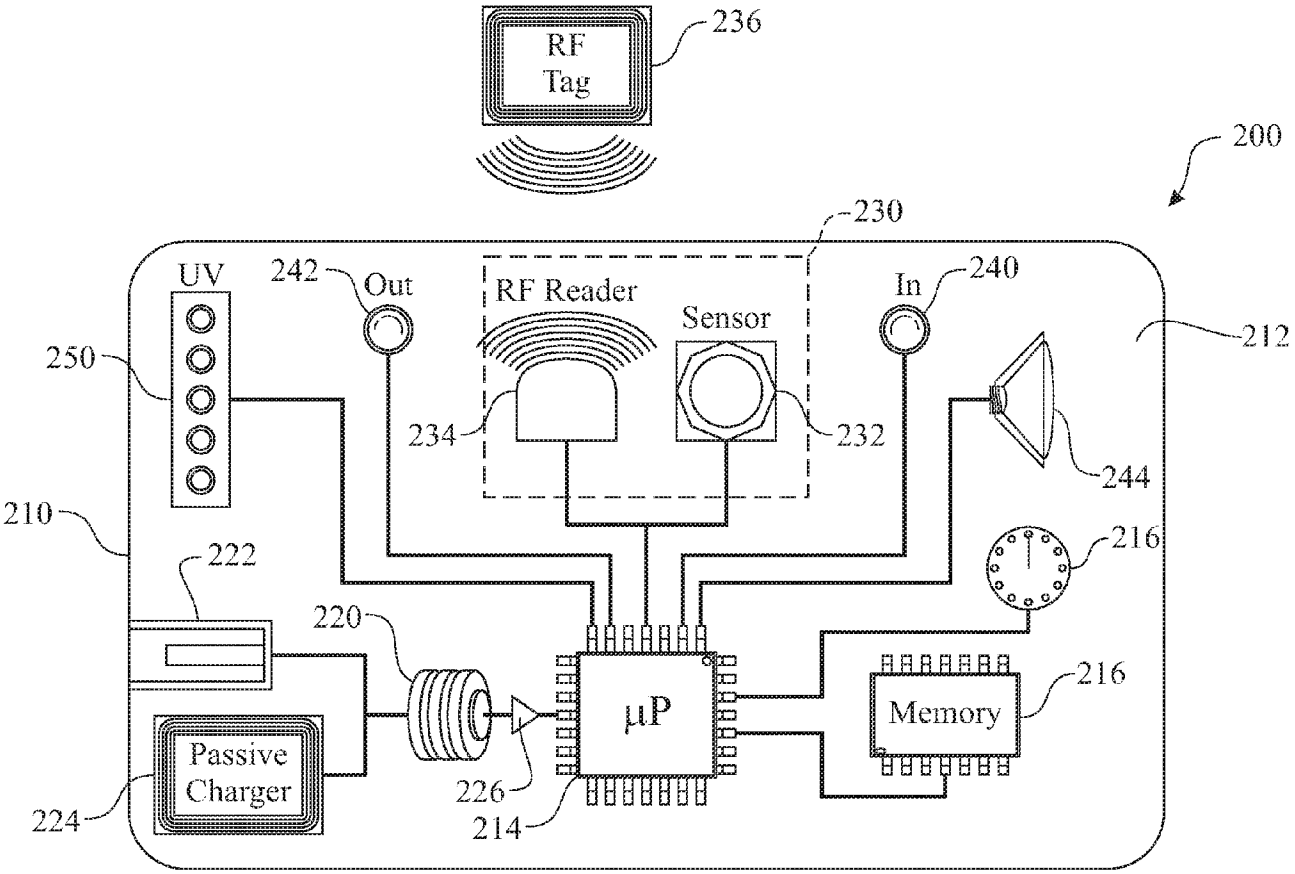
FIG. 4 presents an schematic diagram of the utensil storage monitoring system introduced in FIG. 3.

Details of the utensil storage monitoring system 200 are best shown in a schematic diagram illustrated in FIG. 4. The utensil storage monitoring system 200 would encase a majority of the functional components within a utensil storage monitoring system housing 208 (FIG. 3). The utensil storage monitoring system 200 includes a circuit assembled to a monitoring system printed circuit board (PCB) 212, collectively referred to as a monitoring system printed circuit assembly (PCA) 210. It is understood that a portion of the components may or may not be assembled to the monitoring system printed circuit board (PCB) 212.

Figure 5:
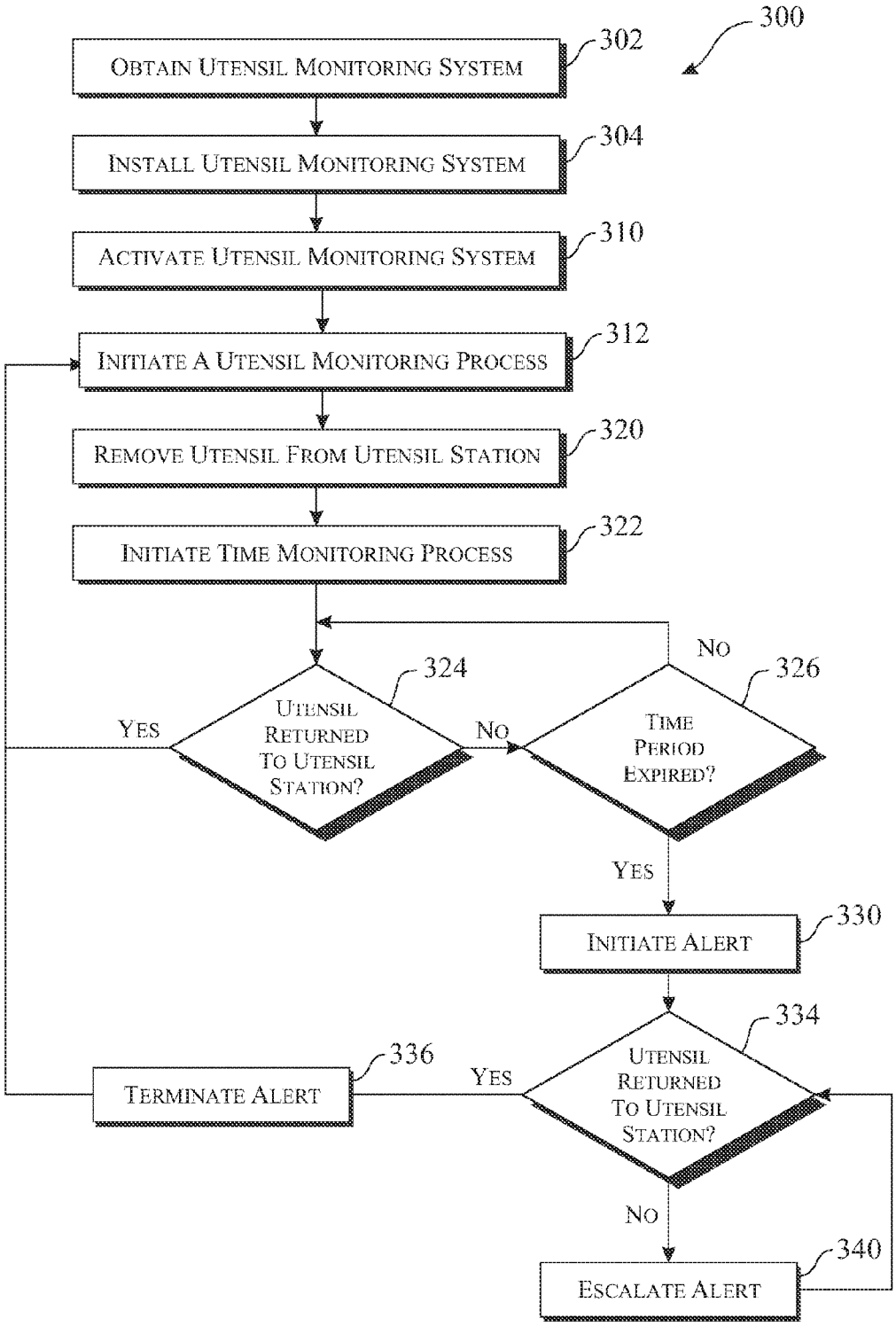
FIG. 5 presents a flow diagram detailing an exemplary utensil status monitoring system.

A monitoring system microprocessor 214 provides the primary operation functionality of the utensil storage monitoring system 200. Storage of digital data and a set of instructions can be stored in a memory portion of the monitoring system microprocessor 214 or in a separate monitoring system digital memory device 216. The monitoring system digital memory device 216 would be in signal communication with the monitoring system microprocessor 214. The set of instructions provides operational instructions to the monitoring system microprocessor 214. The set of instructions define the functionality of the utensil storage monitoring system 200 and are described in a utensil status monitoring system flow diagram 300, as shown in FIG. 5 and described in detail later herein.

Power can be provided by either a monitoring system portable power supply 220 or an external power source providing power through an external power source 222. In an alternative configuration (as shown), the external power source 222 can provide externally supplied power to the monitoring system portable power supply 220, enabling recharging of the monitoring system portable power supply 220. Power can be managed using a power regulator 226. External recharging power can alternatively be provided to the monitoring system portable power supply 220 through a passive power charger 224.

The utensil storage monitoring system 200 can include at least one utensil sensing device 230 to determine when the ice scoop 170 is placed onto or within the ice scoop holster 150. The at least one utensil sensing device 230 can be a presence sensor 232 and/or a radio frequency (RF) reader 234. The presence sensor 232 can be any of the following: a mechanical contact switch, a pressure switch, a lever switch, a proximity sensor, a magnetic sensor, a magnetic read switch, a magnetic proximity fuse, a sonar based sensor, an ultrasonic proximity sensor, an ultraviolet (UV) proximity sensor, a passive thermal sensor, a passive thermal infrared sensor, an acoustic proximity sensor, a light sensor, a capacitive sensor, a capacitive displacement sensor, a Doppler effect sensor, an eddy current sensor, an inductive based sensor, a laser based sensor, a photocell sensor, a radar sensor, a hall effect sensor, and the like. Each of the above identified presence sensors 232 senses a physical presence of the ice scoop 170 within the ice scoop holster 150. A portion of the proposed presence sensors 232 can work with any off the shelf ice scoop 170. Others require a component being attached to the presence sensor 232 or a modification to the presence sensor 232. For example, a magnetic switch may require a magnetic material. In this case, the ice scoop 170 would include a magnetically attractive material or a magnetically attractive material can be attached to an appropriate location of the ice scoop 170.

The radio frequency (RF) reader 234 would require attachment of a radio frequency (RF) tag 236 to the ice scoop 170, as shown in FIGS. 1-3. The radio frequency (RF) reader 234 would interrogate the radio frequency (RF) tag 236 to determine the proximity of the ice scoop 170 to the ice scoop holster 150. In one example, the radio frequency (RF) reader 234 could use a signal strength to determine if the ice scoop 170 is seated within the ice scoop holster 150. The radio frequency (RF) tag 236 would be sufficiently unique to distinguish the specific ice scoop 170 over any other ice scoop 170 or other serving utensil used at the food preparing and/or serving establishment. This feature reduces any risk of cross contamination, which would be directed towards concerns for allergic reactions. The radio frequency (RF) reader 234 can be a radio frequency identification (RFID) transceiver, a Bluetooth transceiver, or any other wireless identification system. It is understood that other variants can be employed; replacing or supplementing the radio frequency (RF) reader 234 and the respective radio frequency (RF) tag 236. For example, the reader can employ light emitted through a series of apertures formed through the ice scoop 170. The apertures would be arranged in a unique pattern providing a unique identity thereof. The pattern can be arranged in a binary pattern. In another example, the radio frequency (RF) reader 234 can be a microchip contact or contactless reader for reading a radio frequency (RF) tag 236, provided as a microchip. The microchip would be encoded with a unique identifier, which is conveyed to the reader when read. It is understood that the reader and associated identifier can be of any suitable reader and associated identifier known by those skilled in the art and suitable for the food serving application.

The utensil storage monitoring system 200 preferably monitors a time period when the ice scoop 170 is removed from the ice scoop holster 150. A clocking circuit 218 is included in the monitoring system printed circuit assembly (PCA) 210 to provide an apparatus for measuring time. The clocking circuit 218 is in signal communication with the monitoring system microprocessor 214.

The utensil storage monitoring system 200 can include any suitable alert or communication element or elements, including visual alerts, audible alerts, or any other suitable alerting device. In regards to a visual alert, the utensil storage monitoring system 200 can include a utensil sensed visual indicator 240 and/or a utensil removed visual indicator 242 to identify a status of the ice scoop 170 respective to the ice scoop holster 150. The utensil sensed visual indicator 240 and/or utensil removed visual indicator 242 can be assembled to the monitoring system printed circuit board (PCB) 212, a utensil storage monitoring system housing 208 (FIG. 3), the ice scoop holster 150, or any other suitable support element. It is understood that a light pipe or other light transfer medium can be employed to direct emitted light to a location that would emit the light such that is it visible to a user. The utensil sensed visual indicator 240 would illuminate and the utensil removed visual indicator 242 would remain off when the ice scoop 170 is inserted into the ice scoop 170. The utensil removed visual indicator 242 would illuminate and the utensil sensed visual indicator 240 would remain off when the ice scoop 170 is removed from the ice scoop 170. The utensil removed visual indicator 242 can change state to identify when the ice scoop 170 has been removed from the ice scoop holster 150 for a period of time that is greater than the predetermined allowable "in-use" time period. For example, the utensil removed visual indicator 242 can change from a solid state to a flashing state when the ice scoop 170 has been removed from the ice scoop holster 150 for a period of time that is greater than the predetermined allowable "in-use" time period. In another example, the utensil removed visual indicator 242 can change color. The utensil removed visual indicator 242 could be illuminated in a yellow or amber color when the ice scoop 170 has been removed from the ice scoop holster 150 and the color would change to a red color when the ice scoop 170 has been removed from the ice scoop holster 150 for a period of time that is greater than the predetermined allowable "in-use" time period.

In regards to an audible alert, the utensil storage monitoring system 200 can include a utensil return request audible alert 244. The utensil return request audible alert 244 can be assembled to the monitoring system printed circuit board (PCB) 212, the utensil storage monitoring system housing 208, the ice scoop holster 150, or any other suitable support element. The utensil removed visual indicator 242 would emit an audible alert when the ice scoop 170 has been removed from the ice scoop holster 150 for a period of time that is greater than the predetermined allowable "in-use" time period. The audible alert can be a continuous sound, a fluctuating sound, a cyclic sound, a textual representation, a musical alert, or any other audible alerting mechanism. The audible alert can be modified as the period of time when the ice scoop 170 has been removed from the ice scoop holster 150 continues. For example, the volume of the audible alert can increase as the period of time continues. In a second example, the style of the alert can be modified to become more noticeable.

The utensil storage monitoring system 200 can include other features, such as a sterilization system 250. One exemplary sterilization system 250 is an ultraviolet light (UV) emitter. A second exemplary sterilization system 250 is heat emitter, such as a steam generator. A third exemplary sterilization system 250 is an ozone emitter. The sterilization system 250 would be installed within the ice scoop holster 150 in a manner suitable for the sterilization process. Installation of the sterilization system 250 would be based upon the selected system. In the illustrated embodiment, the sterilization system 250 is placed along the interior surfaces of the ice scoop holster attachment panel 152 and the ice scoop holster retention panel 154 of the ice scoop holster 150. The sterilization system 250 would be oriented directing the eradicating emissions towards the serving surfaces of the ice scoop 170.

Operation of the utensil storage monitoring system 200 is described in a utensil status monitoring system flow diagram 300 presented in FIG. 5. The process initiates by obtaining the utensil storage monitoring system 200 (step 302). The utensil storage monitoring system 200 can be a provided in the utensil storage monitoring system housing 208 and designed to be retrofitted into existing ice scoop holsters 150 or integrated into the ice scoop holster 150. The utensil storage monitoring system 200 is installed for use (step 304). If the utensil storage monitoring system 200 is designed to be retrofitted into existing ice scoop holster 150, the utensil storage monitoring system 200 is inserted into the ice scoop holster 150 in a manner capable of identifying when the ice scoop 170 is inserted into the ice scoop holster 150 and removed from the ice scoop holster 150. The utensil storage monitoring system 200 can be fixed to the ice scoop 170 using any suitable fixing element, including an adhesive, a bonding agent, a mechanical coupler, screws, snaps, a tie, rivets, a magnetic coupler, and the like. If the utensil storage monitoring system 200 is integrated into the ice scoop holster 150, the ice scoop holster 150 is assembled to the ice distribution container 100. The ice scoop holster 150 would be secured to the ice distribution container 100 using any suitable fixing element, including an adhesive, a bonding agent, a mechanical coupler, screws, snaps, a tie, rivets, a magnetic coupler, and the like.

Once installed, the system is activated (step 310). Activation can be accomplished by providing power to the utensil storage monitoring system 200, toggling a switch (not shown), toggling the utensil sensing device 230, or any other suitable method. The utensil storage monitoring system 200 begins to monitor the status of the ice scoop 170 within the ice scoop holster 150 (step 312). The utensil storage monitoring system 200 identifies a change in state of the ice scoop 170, more specifically, the utensil storage monitoring system 200 determines when the ice scoop 170 is removed from the ice scoop holster 150 (step 320). Upon determining when the ice scoop 170 is removed from the ice scoop holster 150, the utensil storage monitoring system 200 initiates the clocking circuit 218 (step 322). The utensil storage monitoring system 200 continues to increment the time period until the utensil storage monitoring system 200 determines that the ice scoop 170 is returned to the ice scoop holster 150 (decision step 324). The utensil storage monitoring system 200 monitors the removed time period following the removal of the ice scoop 170 from the ice scoop holster 150 and compares the removed time period with a predetermined allowable "in-use" time period. The utensil storage monitoring system 200 determines if the removed time period exceeds the predetermined allowable "in-use" time period (decision step 326). In a condition where the removed time period exceeds the predetermined allowable "in-use" time period, the utensil storage monitoring system 200 initiates an alert sequence (step 330). The alert can be a visual alert, an audible alert, or any other suitable alert. The visual alert can be a solid light 242, a flashing light 242, a backlit stencil, a display monitor, an LED display, and the like. The audible alert can be a continuous tone, a beeping sound or cyclic tone, a message, and the like. Following the activation of the alert, the utensil storage monitoring system 200 continues to monitor the status of the ice scoop 170 and to determine if the ice scoop 170 is returned to the ice scoop holster 150 (decision step 334). If the utensil storage monitoring system 200 senses the return of the ice scoop 170 to the ice scoop holster 150, the utensil storage monitoring system 200 deactivates or terminates the alert (step 336) and returns to the initial monitoring state (step 312). As time continues and the ice scoop 170 is not returned to the ice scoop holster 150, the utensil storage monitoring system 200 can include an optional step of escalating the alert (step 340).

The visual alert can be modified as the period of time when the ice scoop 170 has been removed from the ice scoop holster 150 continues. For example, the color can change from an amber color to a red color. In a second example, the light can change from a steady state to a flashing state.

The audible alert can be modified as the period of time when the ice scoop 170 has been removed from the ice scoop holster 150 continues. For example, the volume of the audible alert can increase as the period of time continues. In a second example, the style of the alert can be modified to become more noticeable.

The utensil storage monitoring system 200 would continue to monitor for the return of the ice scoop 170 to the ice scoop holster 150 (decision step 334).

Figure 6:
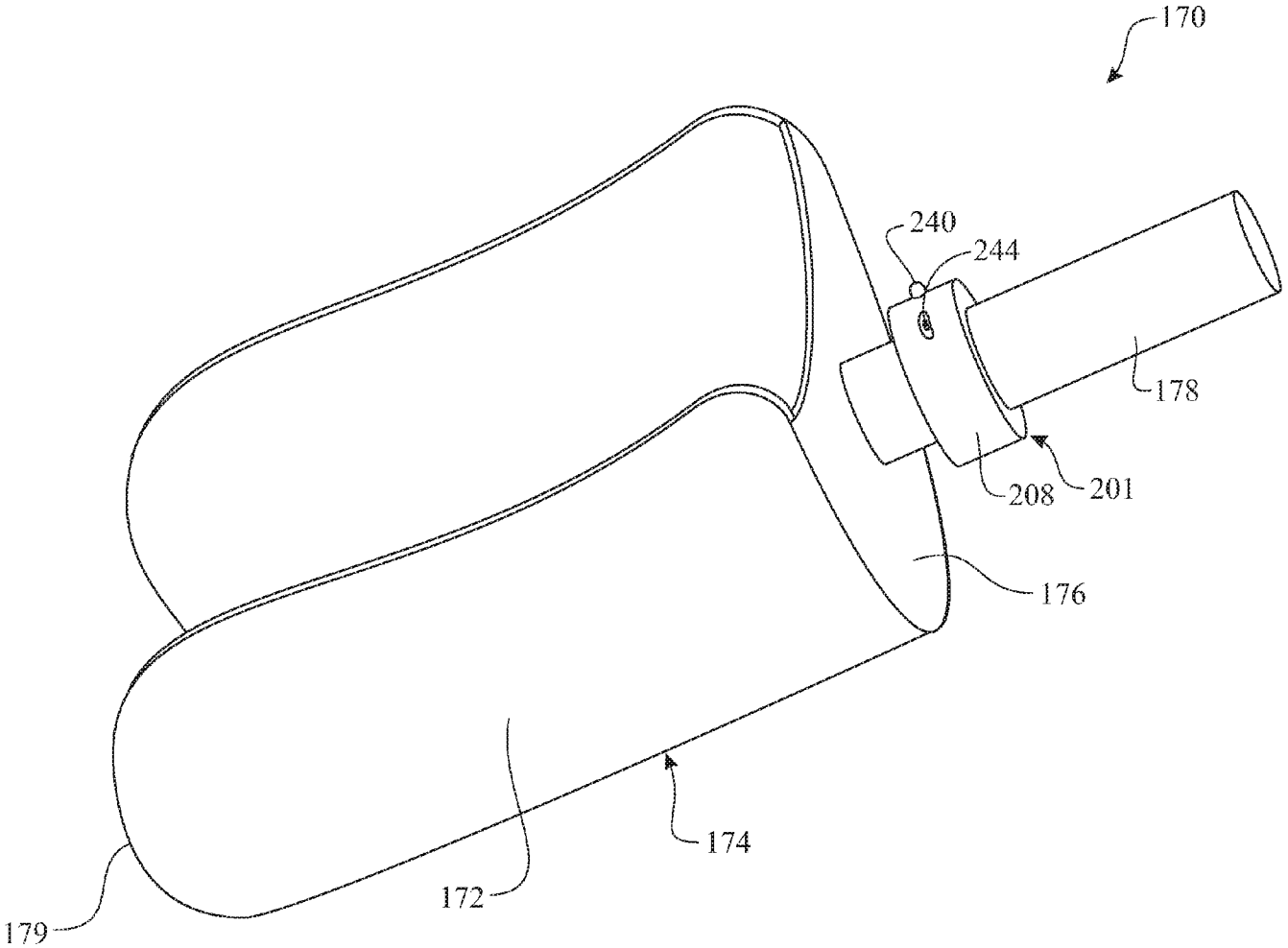
FIG. 6 presents an isometric view of the ice scoop, wherein the utensil status monitoring device is carried by the ice scoop.

The initially described configuration locates the utensil storage monitoring system 200 within the ice scoop holster 150. It is understood that the utensil storage monitoring system 200 can be adapted for other configurations. One example is presented in FIG. 6, where operation of the monitoring system is essentially reversed. More specifically, a utensil storage monitoring system 201 is carried by the ice scoop 170 and the radio frequency (RF) tag 236 would be located at the ice scoop holster 150. The utensil storage monitoring system housing 208 of the utensil storage monitoring system 201 could be water resistant or waterproof to protect the electronics from exposure to any moisture and/or other contaminants. At least one of the utensil sensed visual indicator 240 and utensil return request audible alert 244 can be at least one of integrated into the utensil storage monitoring system housing 208 and located at the ice scoop holster 150.

Figure 7:
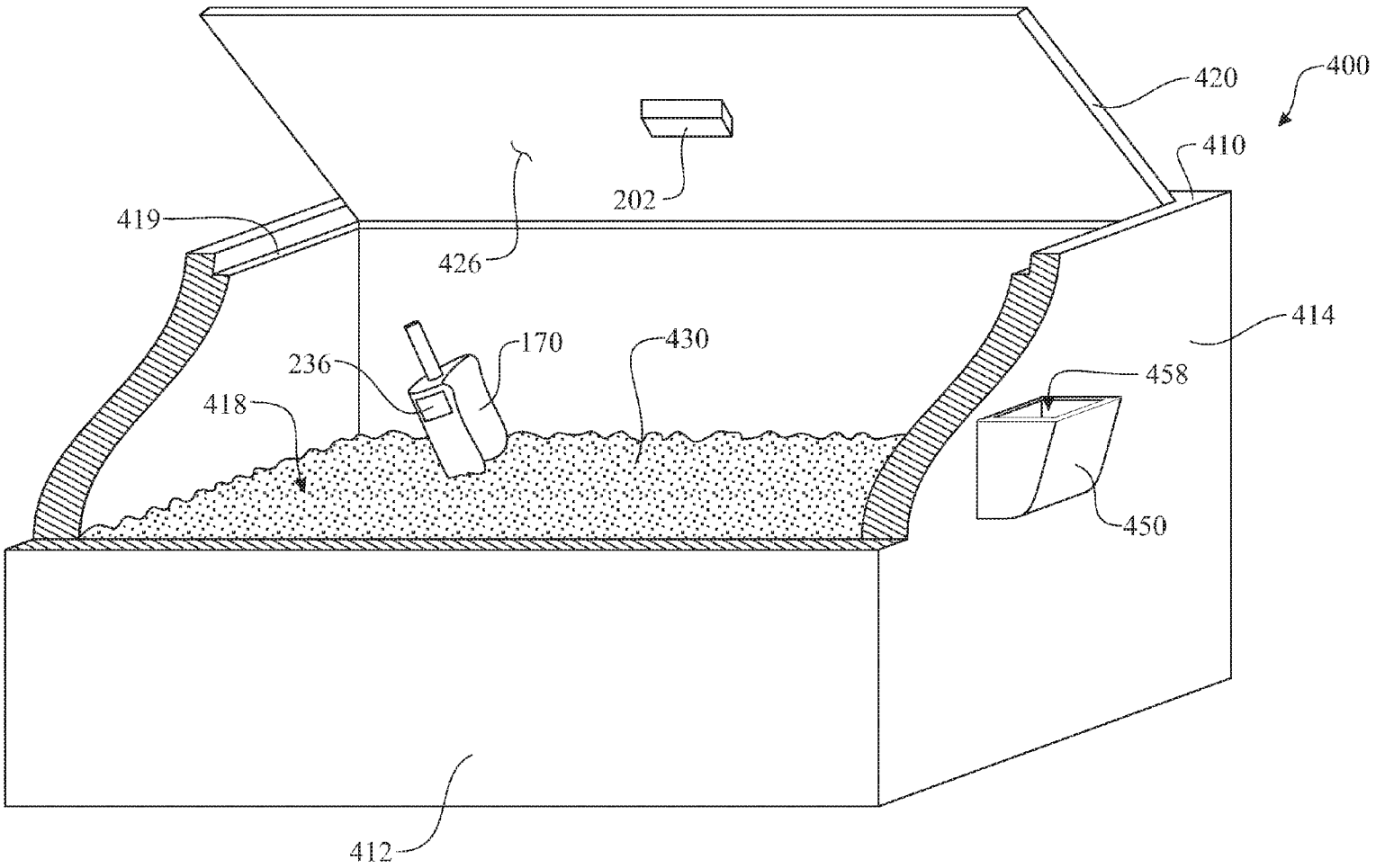
FIG. 7 presents an isometric view of an exemplary ice storage container, wherein the utensil status monitoring device is carried by the ice storage container and adapted to monitor for a condition where the ice scoop remains within the ice storage container beyond a predetermined allowable time span.

A second example is presented in FIG. 7, where a utensil storage monitoring system 202 is adapted to monitor placement of the ice scoop 170 within an ice distribution container 400. The ice distribution container 400 is similar to the ice distribution container 100, wherein like features of the ice distribution container 400 and the ice distribution container 100 are numbered the same except preceded by the numeral '4'. The distinction between the ice distribution container 400 and the ice distribution container 100 is that the ice distribution container 400 employs an alternative configuration of an ice container access panel 420, more specifically, the ice distribution container 100 employs sliding lids and the ice distribution container 400 employs a pivotal ice container access panel 420. The pivotal ice container access panel 420 can be supported by an access panel support rabbet 419 formed within each ice container side panel 414 and/or an ice container front panel 412. The utensil storage monitoring system 202 is carried by the ice distribution container 400, preferably on an ice container access panel lower surface 426 of the ice container access panel 420. The presence sensor 232 of the utensil storage monitoring system 202 would be adapted to identify a presence of the ice scoop 170 within the ice storage volume 418. This can be accomplished using any suitable sensing method known by those skilled in the art. In one exemplary identification method, the radio frequency (RF) tag 236 would be carried by the ice scoop 170 and the presence sensor 232 can sense the presence of the radio frequency (RF) tag 236. The utensil storage monitoring system 202 would initiate a timer upon identification of the presence of the ice scoop 170 within the ice storage volume 418 of the ice distribution container 400. The timer would determine the duration of time when the ice scoop 170 is within the ice storage volume 418. Similar to the operation of the utensil storage monitoring system 200, the utensil storage monitoring system 202 would initiate an alert when the duration of time when the ice scoop 170 is within the ice storage volume 418 exceeds a predetermined allowable time span.

Figure 8:
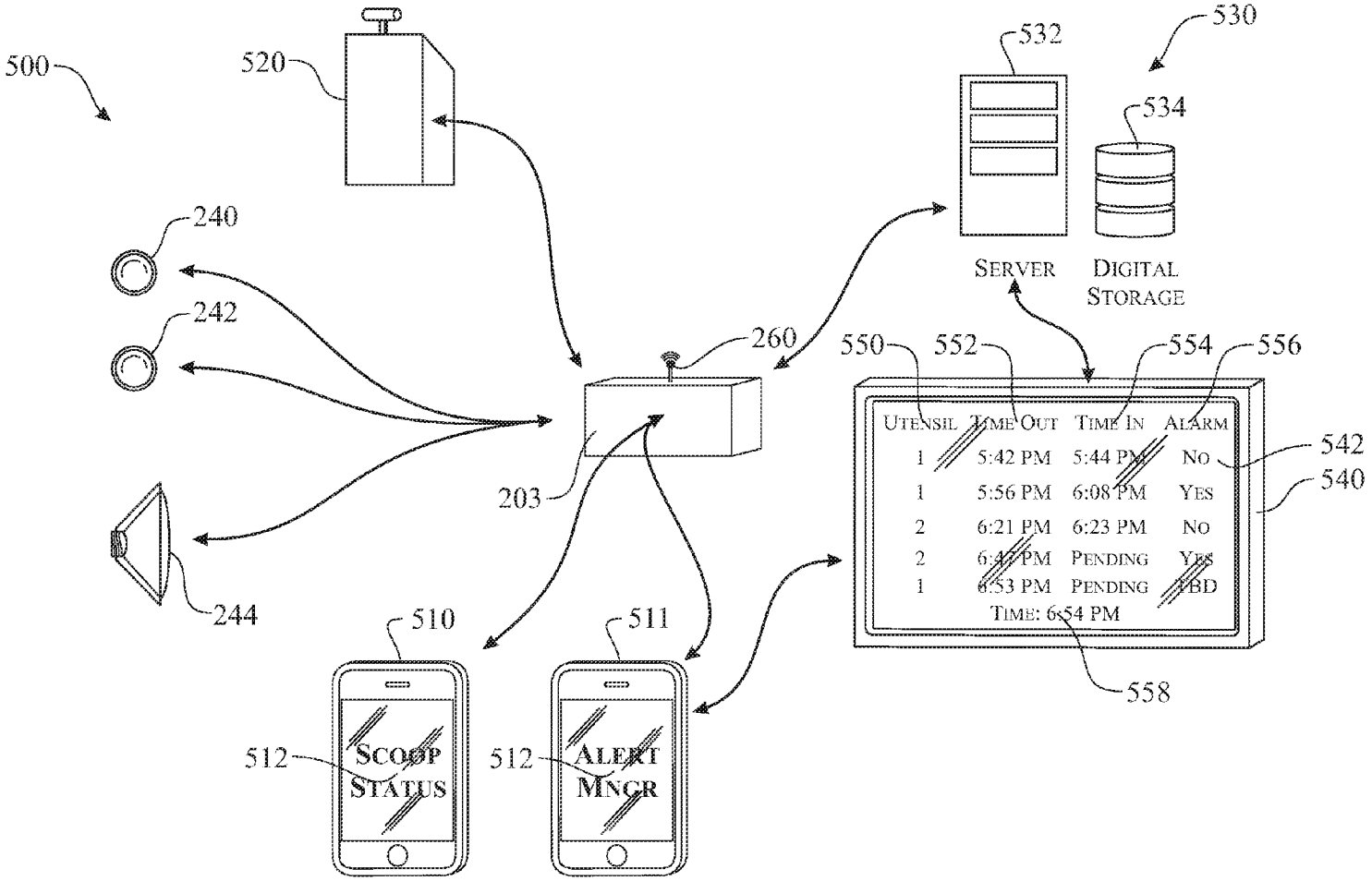
FIG. 8 presents a schematic diagram of an exemplary remote utensil monitoring system.

The implementation and functionality of the monitoring system can be enhanced by introducing any of a number of additional features, as illustrated in an exemplary schematic diagram representing a wireless utensil monitoring system 500, presented in FIG. 8. A utensil storage monitoring system 203 is representative of an enhanced version of the utensil storage monitoring system 200, where the utensil storage monitoring system 203 includes a communication circuit 260. The communication circuit 260 can be a wired communication system and/or preferably a wireless communication circuit. In a wireless communication circuit configuration, the communication circuit 260 can utilize any suitable protocol, including Radio Frequency (RF) such UHF, VHF, and the like; Bluetooth; Wi-Fi; Zigbee, and any other suitable wireless protocol. The communication circuit 260 expands the potential feature set of the utensil storage monitoring system 200. For example, the utensil storage monitoring system 203 can transmit an alert to at least one of a general wireless notification device 510 and a manager's wireless notification device 511. The wireless notification device 510, 511 can be any of a cellular telephone, a Smartphone, a remote server, an email system, a pager, a portable data assistant (PDA), a computing tablet, a point of sale (POS) system), a table seat planning system (represented by a hostess station 520), and the like. The alert can be transmitted as a text message, an email, integrated into an application, using instant messaging, or conveyed using any other suitable process. Upon receipt, the alert would be presented on a display to notify the user of the condition. The general wireless notification device 510 could be carried by a server, a food runner, a cook, a food prep person, a bus person, and the like. The manager's wireless notification device 511 would be carried by a manager or other person having a supervisory role at the location. The alert can be an audible alert; a visual alert in a form of an illuminated light, a flashing light, a displayed message (presented on a wireless notification device display 512 of the device 510, 511), and the like; a tactile alert, and the like and any combination thereof. The utensil storage monitoring system 203 can include a communication link to a utensil status and data acquisition system 530. The utensil status and data acquisition system 530 would include a utensil status monitoring server 532 in signal communication with a utensil status monitoring digital data storage device 534. The 503# would convey information to the utensil status monitoring server 532, which in turn, stores the information on the utensil status monitoring digital data storage device 534. The utensil status monitoring server 532 can optionally include analytical software to analyze the data and proceed accordingly. The utensil status monitoring server 532 can additionally communicate information to the general wireless notification device 510 and/or the manager's wireless notification device 511, such as a request for an alert. The alert can identify one or more utensils (such as the ice scoop 170) that were removed from their respective holster (such as the ice scoop holster 150) for a period of time that exceeds the predetermined allowable time span. Introducing another feature, the utensil status and data acquisition system 530 can provide reports. The reports can manage and retain a history of the monitoring of each utensil. An example of a partial report is presented on a utensil status monitor display 542 of the utensil status monitor 540. The exemplary report is representative of a current state and history of any number of selected utensils. The exemplary report presents a utensil identity 550, a utensil removal time 552, a utensil return time 554, and an alarm activation indicator 556 for two selected utensils. The display would preferably present an actual time 558 as a reference for the user. The exemplary report indicates a history of utensils 1 and 2 as well as a current alarm for utensil 2 (indicated as "Yes") and utensil 1 was removed from the holster and the period of time since the removal of utensil 1 from the holster is currently within an acceptable time period (indicated as "TBD"). The reports can be configured to present other data, such as a period of time between the utensil removal time 552 and the utensil return time 554. The reports can be sorted based upon any selected criteria or series of criteria.

It is understood that the reports can be modified to present any historical data in any desired arrangement. For example, another report can present a current status of one or more utensils within the facility. Another report can present a listing of one or more (preferably all) utensils currently in an alarm status. Storage of the historical data can be utilized to support a health inspection of the facility.

The reports can alternatively be forwarded to any desired recipient, such as the manager's wireless notification device 511, the hostess station 520, or any other desired recipient.

Figure 9:
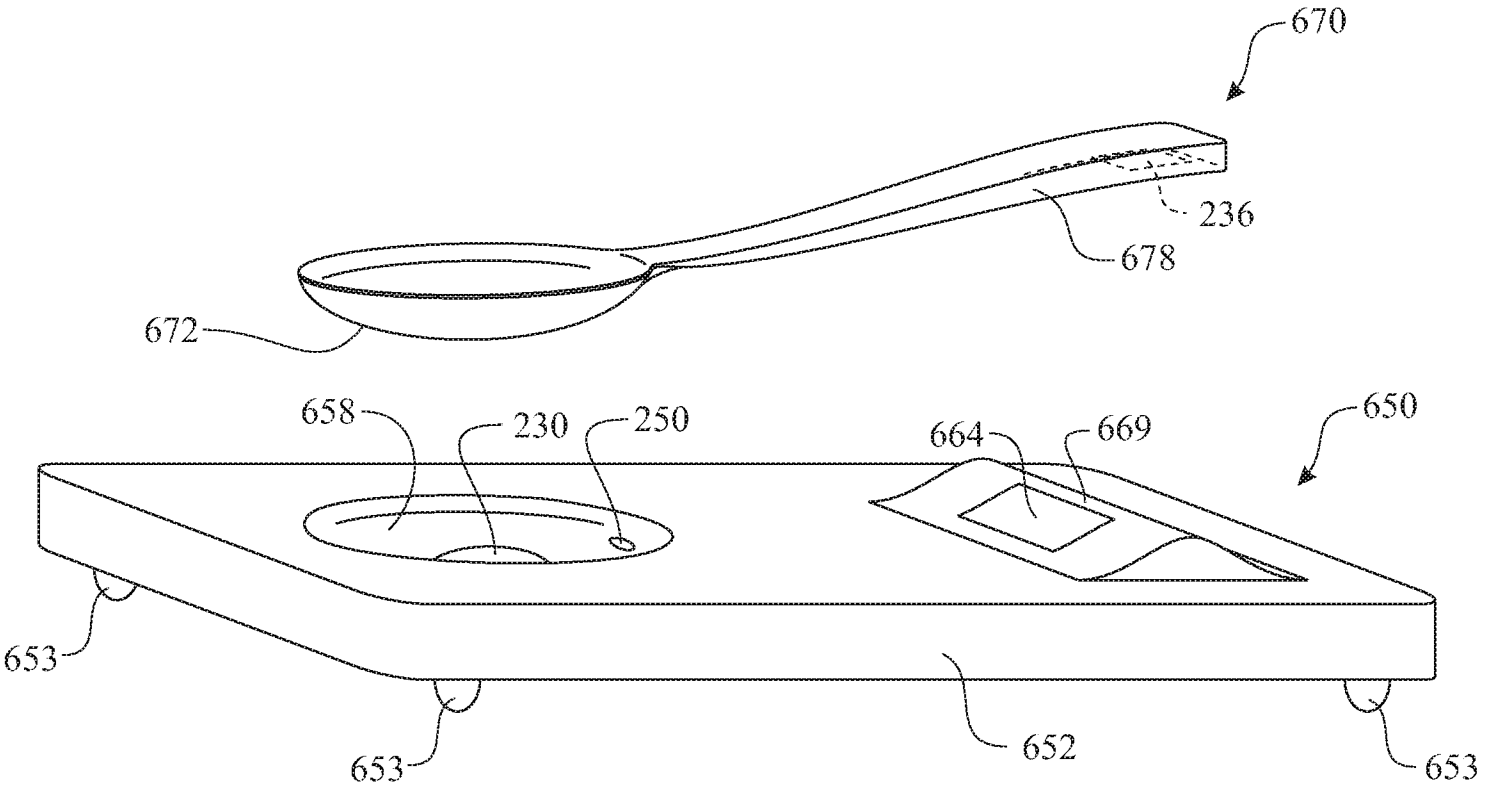
FIG. 9 presents an isometric view of an alternative application of the utensil status monitoring system, wherein the utensil status monitoring system is employed to monitor a status of any utensil.

Although the above described implementation is directed towards the monitoring of the ice scoop 170. It is understood that the utensil storage monitoring system 200 can be adapted to monitor the status of any serving utensil. One example of another implementation is presented in FIG. 9. A utensil storage station 650 is provided to support and store a utensil 670. The exemplary utensil 670 is provided in a form of a spoon, but is representative of any serving utensil, including the spoon, a fork, a knife, a pair of tongs, a ladle, a spatula, a potato masher, a mixing whisk, a beater, a pizza cutter, a baster, and the like. The exemplary utensil 670 is broadly described as having a utensil functional end 672, which is supported by a utensil handle 678. A radio frequency (RF) tag 236 can optionally be attached to the utensil 670. It is preferred that the radio frequency (RF) tag 236 be attached to the utensil handle 678 portion of the utensil 670 to minimize damage to the radio frequency (RF) tag 236.

The utensil storage station 650 includes features to support the respective utensil 670. In the exemplary embodiment, the utensil storage station 650 includes a utensil storage station utensil rest 658 formed within a utensil storage station base 652 for receiving the utensil functional end 672 and a utensil storage station utensil handle support 659 proud or extending upwards from an upper surface of the utensil storage station base 652 for supporting and elevating the utensil handle 678. A plurality of utensil storage station feet 653 can be integral with a bottom surface of the utensil storage station base 652, wherein the utensil storage station feet 653 provide support when the utensil storage station 650 is placed upon a surface. The inclusion of a spatially arranged series of utensil storage station feet 653 is designed to accommodate a non-planar surface, such as a tiled countertop. In one design, the utensil storage station 650 can include three spatially arranged utensil storage station feet 653, as three points defines a plane against any reasonable uneven surface.

The utensil storage monitoring system 200 is integrated into a utensil storage station 650. The utensil sensing device 230 could be located within or proximate the utensil storage station utensil rest 658 or any other suitable location capable of identifying when the utensil 670 is present or removed from the utensil storage station 650. The radio frequency (RF) reader 234 can be located within or proximate the utensil storage station utensil handle support 659 or any other suitable location for reading the radio frequency (RF) tag 236. Installation of the utensil storage monitoring system 200 into the utensil storage station 650 would be based upon the design and material of the utensil storage station 650. The optional sterilization system 250 can be installed into the utensil storage station 650 according to the selected type of system.

It is understood that the basic concept can be modified while maintaining the spirit and intentions of the present invention. For example, the ice scoop holster 150 can be fabricated of a translucent or transparent material. The visual alert can illuminate a portion of or the entire ice scoop holster 150. In another example, the alert can be wired or wirelessly communicated to a master station or a remote station to inform others of an excessively long use of the serving utensil. The master station or remote station can retain a history of alerts, including which station initiated the alert, a time of the initiation of the alert, a longevity of the alert or any other desired statistic.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

Reference Elements

| Ref. No. | Description |
|---|---|
| 100 | ice distribution container |
| 110 | ice container upper surface |
| 112 | ice container front panel |
| 114 | ice container side panel |
| 118 | ice storage volume |
| 120 | ice container upper sliding panel |
| 122 | ice container lower sliding panel |
| 124 | ice container sliding panel hand grip |
| 130 | stored ice |
| 150 | ice scoop holster |
| 152 | ice scoop holster attachment panel |
| 154 | ice scoop holster retention panel |
| 156 | ice scoop holster base panel |
| 158 | holster ice scoop receptacle |
| 170 | ice scoop |
| 172 | ice collecting scoop |
| 174 | ice scoop bottom surface |
| 176 | ice scoop rear surface |
| 178 | ice scoop handle |
| 179 | ice scoop distal edge |
| 200 | utensil storage monitoring system |
| 201 | utensil storage monitoring system |
| 202 | utensil storage monitoring system |
| 203 | utensil storage monitoring system |
| 208 | utensil storage monitoring system housing |
| 210 | monitoring system printed circuit assembly (PCA) |
| 212 | monitoring system printed circuit board (PCB) |
| 214 | monitoring system microprocessor |
| 216 | monitoring system digital memory device |
| 218 | clocking circuit |
| 220 | monitoring system portable power supply |
| 222 | external power source |
| 224 | passive power charger |
| 226 | power regulator |
| 230 | utensil sensing device |
| 232 | presence sensor |
| 234 | radio frequency (RF) reader |
| 236 | radio frequency (RF) tag |
| 240 | utensil sensed visual indicator |
| 242 | utensil removed visual indicator |
| 244 | utensil return request audible alert |
| 250 | sterilization system |
| 260 | communication circuit |
| 300 | utensil status monitoring system flow diagram |
| 302 | obtain utensil monitoring system step |
| 304 | install utensil monitoring system step |
| 310 | activate utensil monitoring system step |
| 312 | initiate a utensil status monitoring process step |
| 320 | identification when utensil is removed from the utensil storage station step |
| 322 | initiate utensil usage time monitoring process |
| 324 | is utensil returned to utensil storage station decision step |
| 326 | is utensil usage time monitoring period expired decision step |
| 330 | initiate alert to return utensil to utensil storage station step |
| 334 | is utensil returned to utensil storage station decision step |
| 336 | terminate the alert step |
| 340 | escalate alert to return utensil to utensil storage station step |
| 400 | ice distribution container |
| 410 | ice container upper surface |
| 412 | ice container front panel |
| 414 | ice container side panel |
| 418 | ice storage volume |
| 419 | access panel support rabbet |
| 420 | ice container access panel |
| 426 | ice container access panel lower surface |
| 430 | stored ice |
| 450 | ice scoop holster |
| 458 | holster ice scoop receptacle |
| 500 | wireless utensil monitoring system |
| 510 | general wireless notification device |
| 511 | manager's wireless notification device |
| 512 | wireless notification device display |
| 520 | hostess station |
| 530 | utensil status and data acquisition system |
| 532 | utensil status monitoring server |
| 534 | utensil status monitoring digital data storage device |
| 540 | utensil status monitor |

-continued

Reference Elements

| Ref. No. | Description |
|---|---|
| 542 | utensil status monitor display |
| 550 | utensil identity |
| 552 | utensil removal time |
| 554 | utensil return time |
| 556 | alarm activation indicator |
| 558 | actual time |
| 650 | utensil storage station |
| 652 | utensil storage station base |
| 653 | utensil storage station feet |
| 658 | utensil storage station utensil rest |
| 659 | utensil storage station utensil handle support |
| 670 | utensil |
| 672 | utensil functional end |
| 678 | utensil handle |

What is claimed is:

1. A serving utensil placement monitoring system, comprising:

a serving utensil storage station configured to store one serving utensil when unused and monitor to ensure that the serving utensil is returned to the same serving utensil storage station within a predetermined time span when the serving utensil is removed from the serving utensil storage station, the serving utensil storage station shaped to present a handle of a serving utensil for gripping by a user, the serving station being located for use at a location proximate to a food serving station;

a microprocessor in communication with a clocking circuit;

a serving utensil proximity sensing device in signal communication with the microprocessor, the serving utensil proximity sensing device being integral with the serving utensil storage station, the serving utensil proximity sensing device being located and configured to identify when the serving utensil is removed from the serving utensil storage station and when the serving utensil is returned to the serving utensil storage station;

at least one alerting component, a portable power supply providing electrical power to electrically powered components of the serving utensil placement monitoring system; and a utensil storage monitoring system housing, wherein the utensil storage monitoring system housing contains at least the microprocessor, the clocking circuit, and the portable power supply therein, wherein the utensil storage monitoring system housing carries at least the serving utensil proximity sensing device, wherein, the microprocessor operates in accordance with a set of utensil monitoring instructions, the set of utensil monitoring instructions including:

sensing, using the serving utensil proximity sensing device, when the serving utensil is moved away from a serving utensil storage location, initiating a clocking of a time span following when the serving utensil is moved away from the serving utensil storage station, monitoring, using the serving utensil proximity sensing device, when the serving utensil is returned to serving utensil storage station, resetting the clocked time span to zero upon return of the serving utensil to the same serving utensil storage station, and activating the at least one alerting component when the clocked time span is at least one of equal to and greater than a predetermined allowable in-use time period.

2. The serving utensil placement monitoring system as recited in claim 1, wherein the serving utensil location sensing device is selected from a group of sensing devices, the group of sensing devices comprising:

a mechanical contact switch, a pressure switch, a lever switch, a proximity sensor, a magnetic sensor, a magnetic read switch, a magnetic proximity fuse, a sonar based sensor, an ultrasonic proximity sensor, an ultraviolet (UV) proximity sensor, a passive thermal sensor, a passive thermal infrared sensor, an acoustic proximity sensor, a light sensor, a capacitive sensor, a capacitive displacement sensor, a Doppler effect sensor, an eddy current sensor, an inductive based sensor, a laser based sensor, a photocell sensor, a radar sensor, a hall effect sensor, and a Radio Frequency IDentification (RFID) reader adapted to read a Radio Frequency (RF) tag.

3. The serving utensil placement monitoring system as recited in claim 1, wherein the alerting component emits at least one of an audible alert, a visual alert, a status signal to a wireless notification device, a status signal to a utensil status monitoring server, and a status signal to a hostess station.

4. The serving utensil placement monitoring system as recited in claim 1, wherein the utensil storage monitoring system housing further carries the at least one alerting component.

5. The serving utensil placement monitoring system as recited in claim 1, the serving utensil location sensing device is adapted to uniquely identify the serving utensil.

6. The serving utensil placement monitoring system as recited in claim 1, wherein the serving utensil storage station is one of a serving utensil rest or a serving utensil holster, wherein the one of the serving utensil rest or the serving utensil holster is adapted to receive the serving utensil.

7. The serving utensil placement monitoring system as recited in claim 1, wherein the utensil storage station is an ice scoop holster, wherein the ice scoop holster is adapted to receive the serving utensil in a form of an ice scoop.

8. The serving utensil placement monitoring system as recited in claim 1, at least one alerting component includes at least one of a utensil sensed indicator and a utensil removed indicator.

9. The serving utensil placement monitoring system as recited in claim 1, further comprising a sterilization system.

10. A method of monitoring a status of a serving utensil placement, the method comprising steps of:

installing a utensil storage monitoring system, the utensil storage monitoring system comprising:

a serving utensil storage station configured to store one serving utensil when unused and monitor to ensure that the serving utensil is returned to the same serving utensil storage station within a predetermined time span when the serving utensil is removed from the serving utensil storage station, the serving utensil storage station shaped to present a handle of a serving utensil for gripping by a user, the serving station being located for use at a location proximate to a food serving station;

a microprocessor in communication with a clocking circuit;

a serving utensil proximity sensing device in signal communication with the microprocessor, the serving utensil proximity sensing device being integral with the serving utensil storage station, the serving utensil proximity sensing device being located and configured to identify when the serving utensil is removed from the serving utensil storage station and when the serving utensil is returned to the serving utensil storage station;

at least one alerting component, a portable power supply providing electrical power to electrically powered components of the serving utensil placement monitoring system; and a utensil storage monitoring system housing, wherein the utensil storage monitoring system housing contains at least the microprocessor, the clocking circuit, and the portable power supply therein, wherein the utensil storage monitoring system housing carries at least the serving utensil proximity sensing device, sensing, using the serving utensil proximity sensing device, when the serving utensil is moved away from a serving utensil storage station, initiating a clocking of a time span following when the serving utensil is moved away from the serving utensil storage station, monitoring, using the serving utensil proximity sensing device, when the serving utensil is returned to serving utensil storage station, resetting the clocked time span to zero upon return of the serving utensil to the same serving utensil storage station, and activating the at least one alerting component when the clocked time span is at least one of equal to and greater than a predetermined allowable in-use time period.

11. A method of monitoring a status of a serving utensil placement as recited in claim 10, the method further comprising a step of installing the utensil storage monitoring system proximate the serving utensil storage station.

12. The method of monitoring a status of a serving utensil placement as recited in claim 10, wherein the step of sensing when a serving utensil is separated from a serving utensil storage station is accomplished by at least one of:

sensing a proximity of the serving utensil respective to the serving utensil storage station using the serving utensil sensor selected from a group of sensors, the group of sensors comprising:

a mechanical contact switch, a pressure switch, a lever switch, a proximity sensor, a magnetic sensor, a magnetic read switch, a magnetic proximity fuse, a sonar based sensor, an ultrasonic proximity sensor, an ultraviolet (UV) proximity sensor, a passive thermal sensor, a passive thermal infrared sensor, an acoustic proximity sensor, a light sensor, a capacitive sensor, a capacitive displacement sensor, a Doppler effect sensor, an eddy current sensor, an inductive based sensor, a laser based sensor, a photocell sensor, a radar sensor, and a hall effect sensor.

13. The method of monitoring a status of a serving utensil placement as recited in claim 10, upon activating the at least one alerting component, the method further comprising a step of emitting at least one of:

an audible alert, a visual alert, a status signal to a wireless notification device, a status signal to a utensil status monitoring server, and a status signal to a hostess station.

14. The method of monitoring a status of a serving utensil placement as recited in claim 10, the method further comprising a step of uniquely identifying the serving utensil.

15. The method of monitoring a status of a serving utensil placement as recited in claim 10, the method further comprising a step of sterilizing the serving utensil when the serving utensil is returned to the serving utensil storage station.

16. A method of monitoring a status of a serving utensil placement, the method comprising steps of:

installing a utensil storage monitoring system, the utensil storage monitoring system comprising:

a serving utensil storage station configured to store one serving utensil when unused and monitor to ensure that the serving utensil is returned to the same serving utensil storage station within a predetermined time span when the serving utensil is removed from the serving utensil storage station, the serving utensil storage station shaped to present a handle of a serving utensil for gripping by a user, the serving station being located for use at a location proximate to a food serving station;

a microprocessor in communication with a clocking circuit;

a serving utensil proximity sensing device in signal communication with the microprocessor, the serving utensil proximity sensing device being integral with the serving utensil storage station, the serving utensil proximity sensing device being located and configured to identify when the serving utensil is removed from the serving utensil storage station and when the serving utensil is returned to the serving utensil storage station;

at least one alerting component, a portable power supply providing electrical power to electrically powered components of the serving utensil placement monitoring system; and a utensil storage monitoring system housing, wherein the utensil storage monitoring system housing contains at least the microprocessor, the clocking circuit, and the portable power supply therein, wherein the utensil storage monitoring system housing carries at least the serving utensil proximity sensing device, sensing, using the serving utensil proximity sensing device, when an ice scoop is moved away from an ice scoop holster, initiating a clocking of a time span following when the ice scoop is moved away from the ice scoop holster, monitoring, using the serving utensil proximity sensing device, when the ice scoop is returned to serving utensil storage station, resetting the clocked time span to zero upon return of the ice scoop to the same ice scoop holster, and activating the at least one alerting component when the clocked time span is at least one of equal to and greater than a predetermined allowable in-use time period.

17. The method of monitoring a status of a serving utensil placement as recited in claim 16, upon activating the at least one alerting component, the method further comprising a step of emitting at least one of:

an audible alert, a visual alert, a status signal to a wireless notification device, a status signal to a utensil status monitoring server, and a status signal to a hostess station.

18. The method of monitoring a status of a serving utensil placement as recited in claim 16, wherein the step of installing a utensil storage monitoring system is accomplished by installing the utensil storage monitoring system into one of:

A) an ice scoop holster,

B) the ice scoop,

C) a handle of the ice scoop, and

D) an ice distribution container.

19. The method of monitoring a status of a serving utensil placement as recited in claim 16, further comprising steps of:

identifying when the ice scoop is returned to the ice scoop holster; and sanitizing the ice scoop.

* * * * *